US006354517B1

(12) United States Patent
Wu

(10) Patent No.: US 6,354,517 B1
(45) Date of Patent: Mar. 12, 2002

(54) AIRBRUSH

(76) Inventor: Yu-Chih Wu, 13/F-1, No. 16, Lane 15, Fulien St., Hsitun Dist., Taichung City (TW)

( * ) Notice: Subject to any disclaimer, the term of this patent is extended or adjusted under 35 U.S.C. 154(b) by 0 days.

(21) Appl. No.: 09/658,633

(22) Filed: Sep. 8, 2000

(51) Int. Cl.[7] ..... B05B 7/30
(52) U.S. Cl. ..... 239/353; 239/414; 239/378
(58) Field of Search ..... 239/353, 378, 239/414

(56) References Cited

U.S. PATENT DOCUMENTS 555,669 A * 3/1896 Wold
1,268,403 A * 6/1918 Stacker
1,299,290 A * 4/1919 Berg
1,703,359 A * 2/1929 Paasche
4,161,289 A * 7/1979 Rebold
4,978,072 A * 12/1990 Kurowski
5,094,400 A * 3/1992 Ching
5,366,158 A * 11/1994 Robisch et al.
5,454,517 A * 10/1995 Naemura

* cited by examiner

*Primary Examiner*—Lesley D. Morris
(74) *Attorney, Agent, or Firm*—Rosenberg, Klein & Lee

(57) ABSTRACT

An airbrush in which the main lever has a arched bottom recess coupled to the spherical top end of the piston rod of the air valve, so that the main lever can be conveniently turned to open the paint passage when pressed to open the air passage, and the fluid cup can be alternatively fastened to two opposite sides of the barrel to fit the left-handed/right handed user.

6 Claims, 5 Drawing Sheets

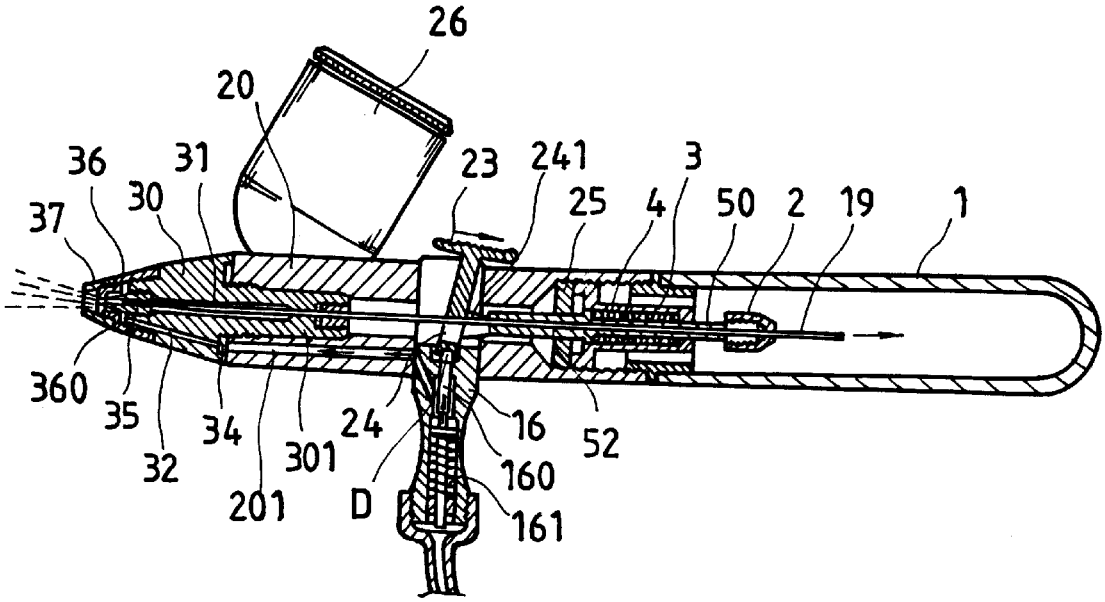
FIG.5
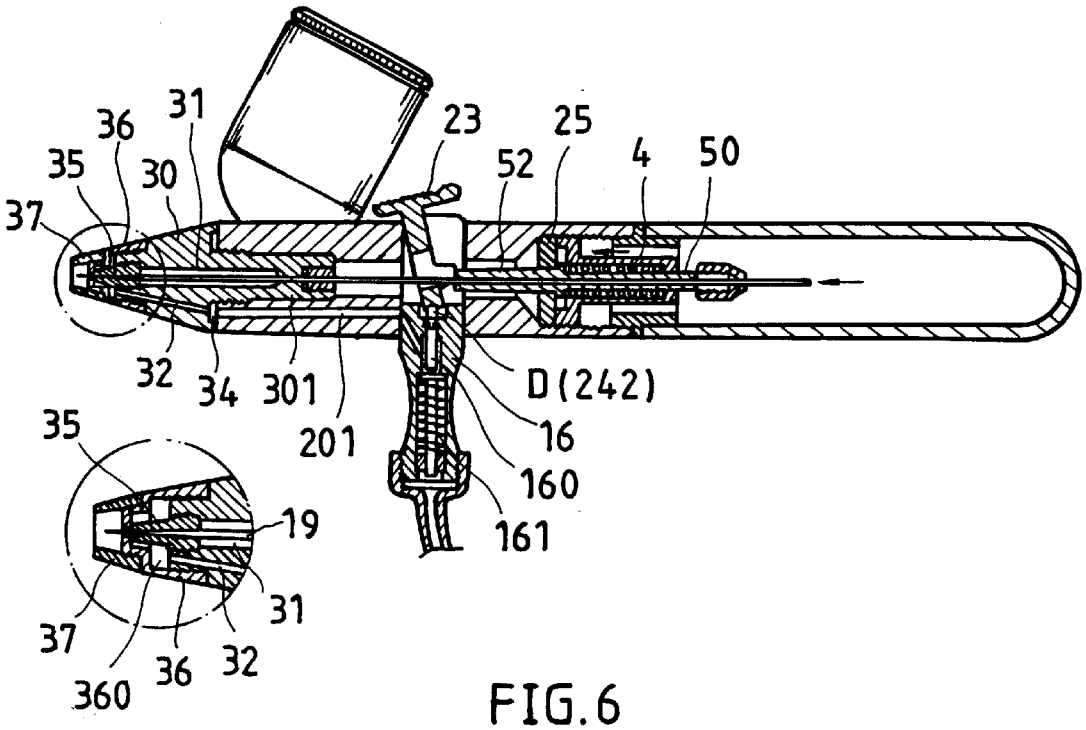
FIG.6
FIG.6A

AIRBRUSH

BACKGROUND OF THE INVENTION

The present invention relates to airbrushes, and more particularly to a high-performance airbrush, which can be conveniently adjusted to fit the left-handed user, or the right-handed user.

FIGS. from 1 through 3 show an airbrush according to the prior art. This structure of airbrush comprises a barrel 10, the barrel comprising an integrated fluid cup 12, a backwardly extended receiving hole 14, a paint passage 11 extended from the backwardly extended receiving hole 14 through the fluid cup 12 to the front end thereof, a transverse through hole 13, an air passage 130 extended from the transverse through hole 13 to the front end, and a positioning frame 132 disposed in the transversely extended through hole 13, an air valve 16 mounted in the transverse through hole 13 at a bottom side, the air valve 16 comprising a piston rod 160 adapted to close/open the air passage 130, and a spring 161 adapted to force the piston rod 160 to close the air passage 130, a nozzle cap 17 fastened to the front end of the barrel 10 to hold a nozzle tip 18, a needle holder 5 axially slidably mounted in the barrel 10, a needle 19 fastened to the needle holder 5 and moved with the needle holder 5 to close/open the air passage 130 and the paint passage 11 to the nozzle tip 18, a spring cap 3 coupled to the needle holder 5, a spring 4 mounted in the spring holder 3 and adapted to force the needle holder 5 forwards, a cap nut 2 threaded onto the threaded rear end 6 of the needle holder 5 to secure the spring holder 3 in place, an end cap 1 fastened to the rear end of the barrel 10, and a main lever 15 mounted in the transversely extended through hole 13 at a top side and coupled to the positioning frame 132 and adapted to move the needle holder 5 and the piston rod 160 in opening the paint passage 11 and the air passage 130. The main lever 15 comprises a bottom coupling rod 152 pivoted to the positioning frame 132, a push plate 150 stopped at the front end of the needle holder 5, and a needle hole 151 extended through the push plate 150 for the passing of the needle 19. When the user presses the main lever 15 and then turned the main lever 15 backwards, the piston rod 160 is lowered to open the air passage 130, and the needle 19 is moved backwards with the needle holder 5 to open the air passage 11, and therefore a paint is driven out of the air chamber 170 in the nozzle cap 17 and the nozzle tip 18 by compressed air passing from the air valve 16. This structure of airbrush is still not satisfactory in function. The drawbacks of this structure of airbrush are numerous and outlined hereinafter.

1. The arrangement of the bottom coupling rod 152 of the main lever 15 and the positioning frame 132 of the barrel 10 greatly complicates the manufacturing process and cost of the airbrush, and the bottom coupling rod 152 of the main lever 15 wears quickly with use.

2. Because the push plate 150 is welded to the main lever 15, it may not be accurately fastened to the main lever 15 to the desired angle, causing the push plate 150 unable to positively push the needle holder 5 to the set distance.

3. During the movement of the needle holder 5, the needle 19 may vibrate or not accurately aligned, causing a bad painting result.

4. When the needle 5 is forced into the nozzle cap 17, the pointed front tip of the needle 5 tends to be deformed.

5. Because the air passage 130 is obliquely extended from the transversely extended through hole 13 to the front end of the barrel 10, it is difficult to clean the air passage 130.

6. Because the fluid cup 12 is formed integral with the barrel 10, it is in the way of the user's sight when the user operating the airbrush and watching the nozzle tip 18, and cannot be adjusted to the desired angle to fit the left-handed user or right-handed user.

SUMMARY OF THE INVENTION

The present invention has been accomplished to provide an airbrush, which eliminates the aforesaid drawbacks. It is one object of the present invention to provide an airbrush, which is easy and inexpensive to manufacture. It is another object of the present invention to provide an airbrush, which achieves high performance. It is still another object of the present invention to provide an airbrush, which is easy to maintain. It is still another object of the present invention to provide an airbrush, which is durable in use. It is still another object of the present invention to provide an airbrush, which can conveniently be adjusted to fit the left-handed user, or the right-handed user. According to one aspect of the present invention, the airbrush comprises a barrel, the barrel comprising a transversely extended through hole, an air valve mounted in the through hole of the barrel at a bottom side, the air valve comprising an air hole, a piston rod adapted to close/open the air hole of the air valve, and spring means adapted to force the piston rod to close the air hole of the air valve, a nozzle head fastened to the front end of the barrel, a nozzle cap fastened to the nozzle head to hold a nozzle tip, a needle holder mounted in the barrel and axially moved in the barrel, a needle fastened to the needle holder and moved with the needle holder to close/open the paint passage through the nozzle head and the nozzle tip, a spring cap fastened to a rear end of the needle holder, a spring mounted in the spring cap to support the needle holder in a front position where the needle closes the paint passage, and a fluid cup fastened to the barrel and adapted to provide a paint to the nozzle head for enabling the pair to be forced out of the nozzle tip by compressed air passing from the air valve, and a main lever mounted in the through hole of the barrel at a top side and adapted to move the piston rod in opening the air hole of the air valve and to simultaneously move the needle holder and the needle in opening the paint passage, wherein the main lever comprises a through hole for the passing of the needle, a push rod stopped at a front end of the needle holder, and an arched bottom recess, which receives a spherical top end of the piston rod for enabling the main lever to be turned on the spherical top end of the piston rod to push the needle barrel backwards in opening the pain passage after the main lever had been pressed to move the piston rod downwards in opening the air hole of the air valve. According to another aspect of the present invention, the push rod is formed integral with the main lever for moving the needle holder positively. According to another aspect of the present invention, the nozzle head is stopped at the front end of the barrel, comprising a rear extension mounting portion fastened to the inside of the front end of the barrel, a longitudinal center through hole extended through the rear extension mounting portion in communication between the nozzle tip and the inside of the barrel and adapted to guide movement of the needle in course, a fluid hole perpendicularly outwardly extended from the longitudinal center through hole and adapted to receive a paint from the fluid cup, an outside annular groove disposed around the periphery of a front end of the rear extension mounting portion, and a plurality of air passages extended to a front end thereof and disposed in communication with the outside annular groove and adapted to receive compressed air from the air valve. According to still another aspect of the present invention, the oblique air passages of the nozzle head are short, and the horizontal air passage of the barrel is relatively longer. Because the nozzle head and the barrel are separated members, the processing of the air passages is not complicated. According to still another aspect of the present invention, the air passages of the nozzle head are equiangularly spaced around the longitudinal center through hole in communication between the outside annular groove of the nozzle head and the nozzle tip, enabling paint to be driven out of the nozzle tip in streams uniformly. According to still another aspect of the present invention, the elongated rear extension mounting portion of the nozzle head has a length sufficient to guide the movement of the needle stably. According to still another aspect of the present invention, nozzle element installed in the front end of the nozzle head and adapted to receive the needle for enabling the needle to close the paint passage, the nozzle element comprising a narrow axial center through hole disposed in communication between the nozzle tip and the longitudinal center through hole of the nozzle head and adapted to receive the pointed front tip of the needle, preventing the pointed front tip of the needle from being deformed. According to still another aspect of the present invention, the barrel comprises two transverse mounting holes aligned at two opposite sides, a fluid tube selectively fastened to one of the transverse mounting holes and adapted to receive the fluid cup, and a plug adapted to close one of the transverse mounting holes. By means of this arrangement, the fluid cup can be installed in the barrel at the left side or the right side as desired.

BRIEF DESCRIPTION OF THE DRAWINGS

FIG. 5 is a sectional view of the present invention, showing the air passage and the paint passage of the airbrush opened.

FIG. 6 is similar to FIG. 5 but showing the air passage and the paint passage closed.

FIG. 6A is an enlarged view of a part of FIG. 6.

DETAILED DESCRIPTION OF THE PREFERRED EMBODIMENT

Figure 1:
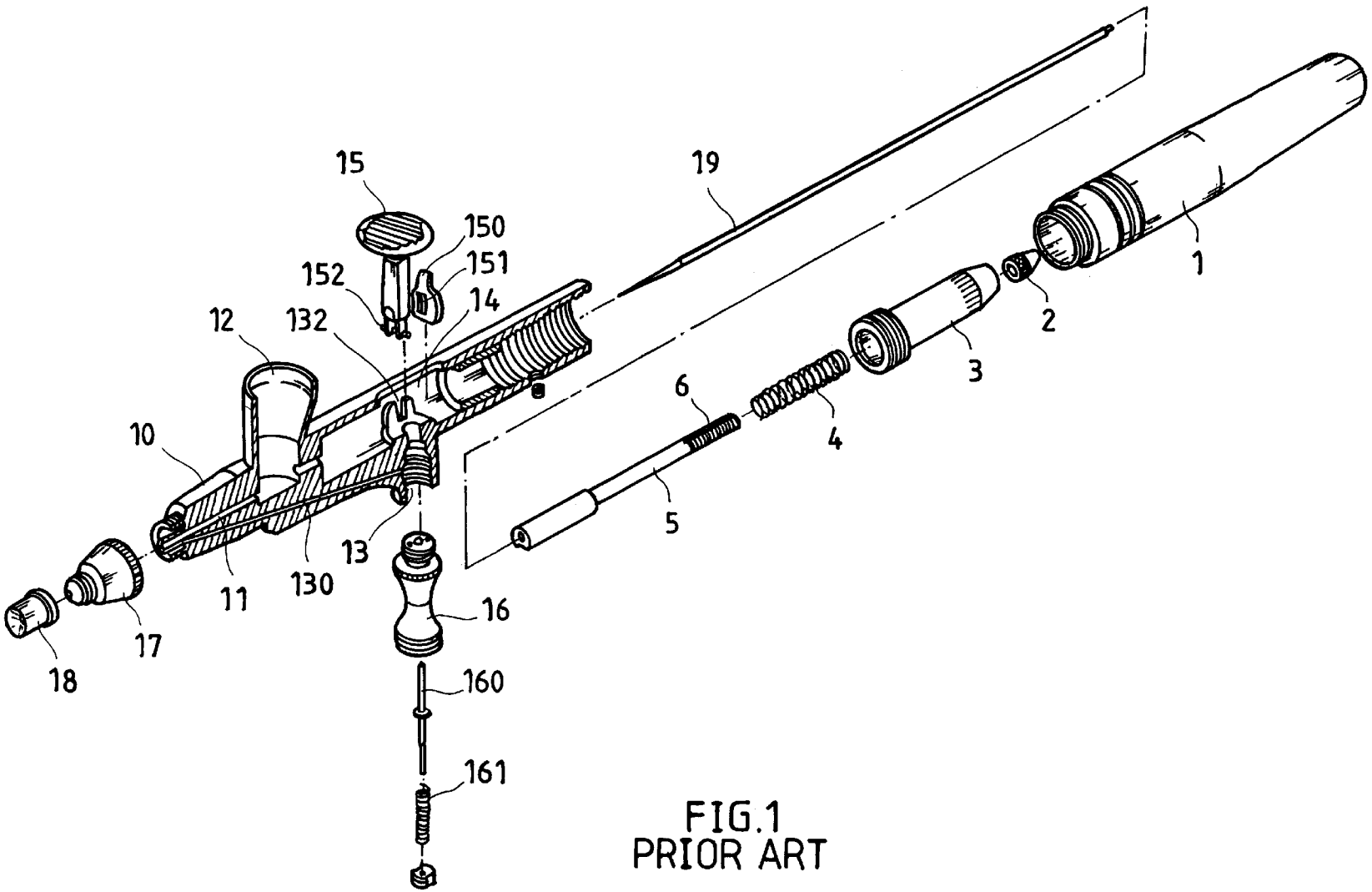
FIG.1 PRIOR ART
FIG. 1 is an exploded view of an airbrush according to the prior art.
Figure 2:
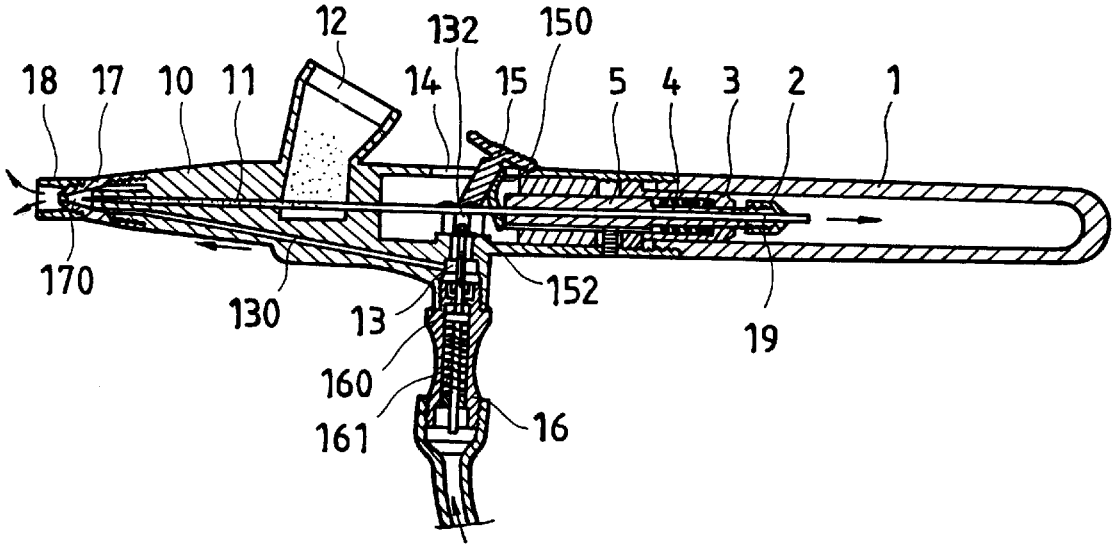
FIG. 2 PRIOR ART
FIG. 2 is a sectional view of the prior art airbrush showing the air passage and the paint passage opened.
Figure 3:
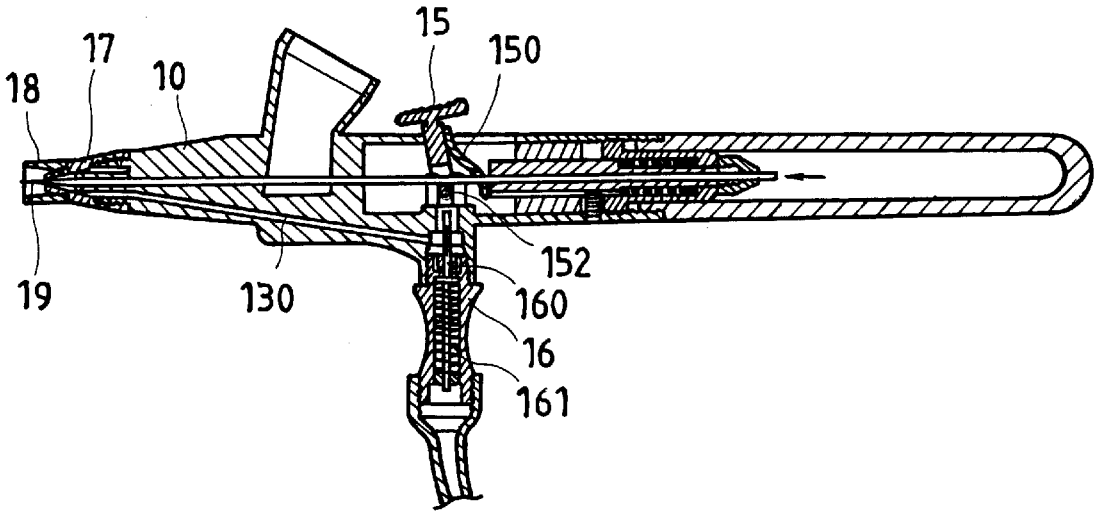
FIG. 3 PRIOR ART
FIG. 3 is similar to FIG. 2 but showing the air passage and the paint passage closed.
Figure 4:
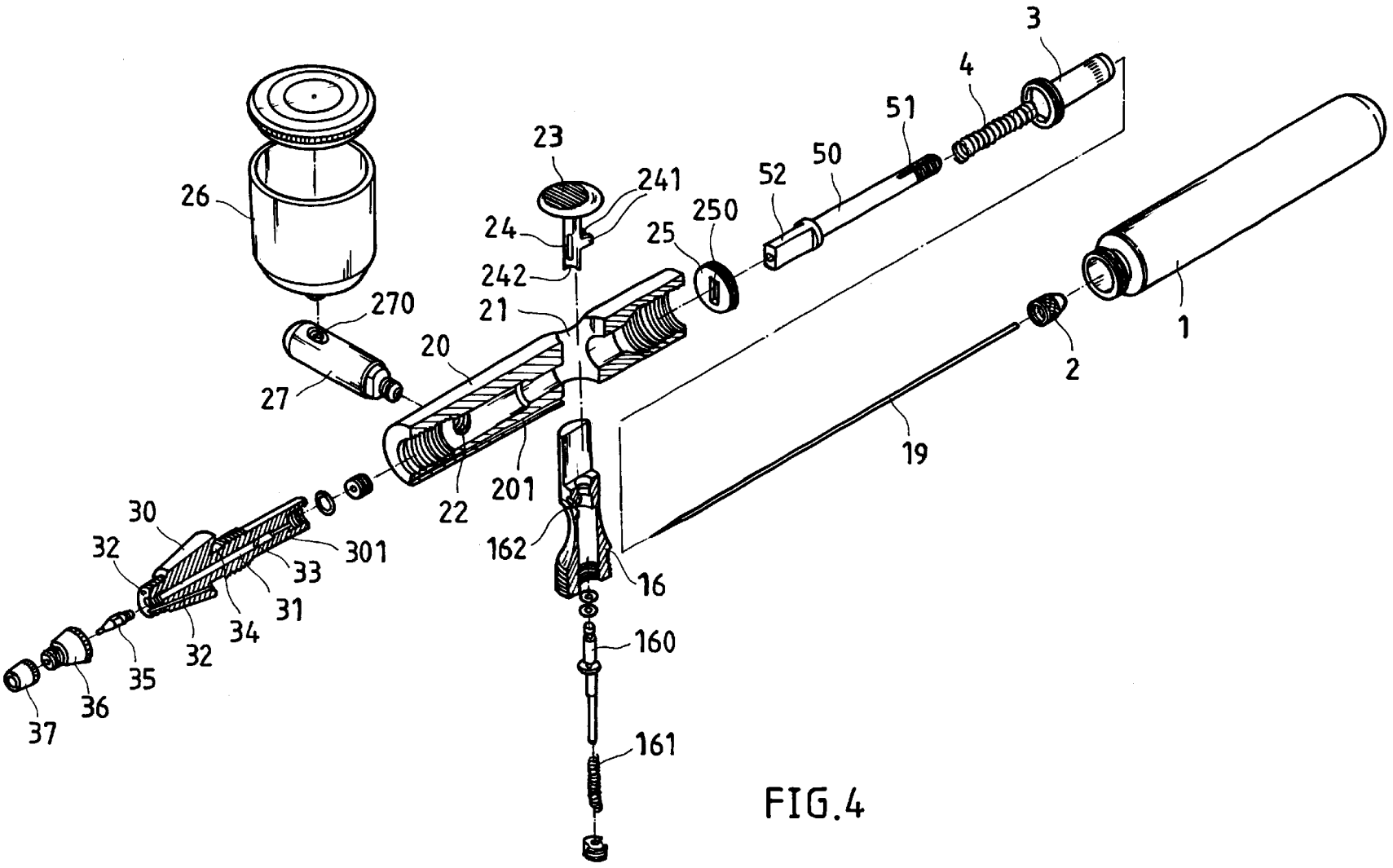
FIG. 4 is an exploded view of an airbrush according to the present invention.

Referring to FIGS. 4 and 5, an airbrush in accordance with the present invention is generally comprised of a barrel 20, a nozzle head 30, a nozzle cap 36, a nozzle tip 37, a main lever 23, an air valve 16, which comprises an air hole 162, a piston rod 160 and a spring 161, a needle 19, a needle holder 50, the needle holder 50 having a longitudinal split 51 at the rear end thereof, a spring 4, a nut 2, a spring cap 3, an end cap 1, and a fluid cup 26. The barrel 20 has a transversely extended through hole 21 adapted to receive the main lever 23 and the air valve 16.The needle 19 is mounted in the needle holder 50. The needle holder 50 is inserted through the spring 4 and the spring cap 3, and screwed up with the nut 2. After installation of the needle holder 50 with the needle 19 in the barrel 20, the tip of the needle 19 is inserted into the longitudinal center through hole 31 of the nozzle head 30.The nozzle head 30 is fastened to the front end of the barrel 20. The nozzle tip 37 is threaded onto the nozzle cap 36, and then the nozzle cap 36 is fastened to the front end of the nozzle head 30.

The barrel 20 comprises an air passage 201 disposed in communication with the air hole 162 of the air valve 16, and two transverse mounting holes 22 aligned at two opposite sides adapted to receive paint from the fluid cup 26.

Figure 7:
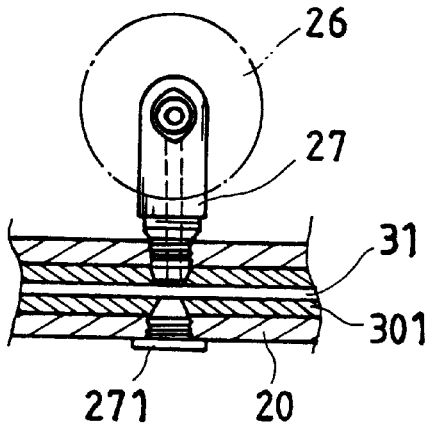
FIG. 7 is a sectional view of a part of the present invention, showing an installation example of the fluid cup.
Figure 8:
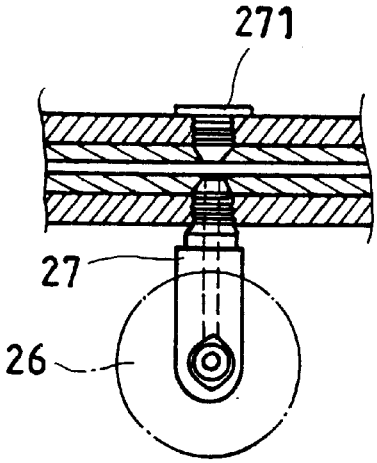
FIG. 8 is a sectional view of a part of the present invention, showing another installation example of the fluid cup.

The fluid cap 26 is detachably fastened to one transverse mounting hole 22 of the barrel 20 by a fluid tube 27. The fluid tube 270 has a front open end fastened to the selected transverse mounting hole 22 of the barrel 20 (see also FIG. 7), and a screw hole 270 radially disposed near the rear close end thereof and adapted to receive the fluid cup 26. The other transverse mounting hole 22 is blocked with a plug 271. Because the barrel 20 has two transverse mounting holes 22 aligned at two opposite sides, the fluid cup 26 can be installed in either transverse mounting hole 22 to fit the right-handed user (see FIG. 7) or left-handed user (see FIG. 8).

The nozzle head 30 is stopped at the front end of the barrel 20, comprising a rear extension mounting portion 301 fastened to the inside of the front end of the barrel 20, a fluid hole 33 perpendicularly outwardly extended from the longitudinal center through hole 31 and adapted to receive paint from the fluid cup 26, an outside annular groove 34 disposed around the periphery of the front end of the rear extension mounting portion 301, and a plurality of air passages 32 extended to the front end thereof and disposed in communication with the outside annular groove 34 and adapted to receive compressed air from the air valve 16 via the air passage 201 in the barrel 20.

The main lever 23 comprises a through hole 24 for the passing of the needle 19, a push rod 241 formed integral with the periphery thereof and stopped at the front end of the needle holder 50, and an arched bottom recess 242, which receives the spherical top end of the piston rod 160. When pressing the main lever 23, the piston rod 160 is pushed downwards to open the air hole 162, enabling compressed air to pass out of the air valve 16 into the air passage 201 of the barrel 20 and the air passages 32 of the nozzle head 30. After pressing, the main lever 23 can be turned about the pivot point D, namely, the spherical head of the piston rod 160 to push the needle holder 50 backwards, causing the needle 19 to open the paint passage.

The needle holder 50 is longitudinally slidably secured to the inside of the barrel 20 by a locating plate 25, comprising a non-circular front head 52 inserted through the guide hole 250 of the locating plate 25 and stopped against the push rod 241 of the main lever 23.

The nozzle head 30 further comprises a nozzle element 35 mounted in the front end thereof. The nozzle element 35 has a narrow axial center through hole for the passing of the tip of the needle 19 to guide movement of the needle 19 in course, and to prevent the tip of the needle 19 from damage.

Before operating the main lever 23, as shown in FIGS. 6 and 6A, the needle holder 50 is forced forwards by the spring 4, the needle 19 is inserted into the nozzle element 35 to stop the paint passage between the nozzle head 30 and the nozzle tip 37, and the piston rod 160 is pushed upwards by the spring 161 to close the air hole 162. When pressing the main lever 23 and then turning the main lever backwards, the piston rod 160 is pushed downwards to open the air hole 162, enabling compressed air to pass out of the air valve 16 through the air passage 201 of the barrel 20 and the air passages 32 of the nozzle head 30 to the nozzle tip 37 via the air chamber 360 in the nozzle cap 36, and at the same time the needle holder 50 is forced by the push rod 241 of the main lever 23 to carry the needle 19 backwards from the nozzle element 35, enabling paint to pass from the fluid cup 26 through the fluid tube 27, the barrel 20, the nozzle head 30 to the outside of the nozzle tip 37. When releasing the main lever 23, the needle holder 50 and the piston rod 160 are respectively pushed back to their former positions by the respective springs 4 and 161 to close the paint passage and the air passage (see FIG. 5).

While only one embodiment of the present invention has been shown and described, it will be understood that various modifications and changes could be made thereunto without departing from the spirit and scope of the invention disclosed.

What the invention claimed is:

1. An airbrush comprising a barrel, said barrel comprising a transversely extended through hole, an air valve mounted in the through hole of said barrel at a bottom side, said air valve comprising an air hole, a piston rod adapted to close/open the air hole of said air valve, and spring means adapted to force said piston rod to close the air hole of said air valve, a nozzle head fastened to a front end of said barrel, a nozzle cap fastened to said nozzle head to hold a nozzle tip, a needle holder mounted in said barrel and axially moved in said barrel, a needle fastened to said needle holder and moved with said needle holder to close/open a paint passage through said nozzle head and said nozzle tip, a spring cap fastened to a rear end of said needle holder, a spring mounted in said spring cap to support said needle holder in a front position where said needle closes the paint passage, and a fluid cup fastened to said barrel and adapted to provide a paint to said nozzle head for enabling the pair to be forced out of said nozzle tip by compressed air passing from said air valve, and a main lever mounted in the through hole of said barrel at a top side and adapted to move said piston rod in opening the air hole of said air valve and to simultaneously move said needle holder and said needle in opening said paint passage, wherein said main lever comprises a through hole for the passing of said needle, a push rod stopped at a front end of said needle holder, and an arched bottom recess, which receives a spherical top end of said piston rod for enabling said main lever to be turned on said spherical top end of said piston rod to push said needle barrel backwards in opening said pain passage after said main lever had been pressed to move said piston rod downwards in opening the air hole of said air valve.

2. The airbrush of claim 1 wherein said nozzle head is stopped at the front end of said barrel, comprising a rear extension mounting portion fastened to the inside of the front end of said barrel, a longitudinal center through hole extended through said rear extension mounting portion in communication between said nozzle tip and the inside of said barrel, a fluid hole perpendicularly outwardly extended from said longitudinal center through hole and adapted to receive a paint from said fluid cup, an outside annular groove disposed around the periphery of a front end of said rear extension mounting portion, and a plurality of air passages extended to a front end thereof and disposed in communication with said outside annular groove and adapted to receive compressed air from said air valve.

3. The airbrush of claim 1 wherein said needle holder is longitudinally slidably secured to the inside of said barrel by a locating plate having a guide hole, comprising a non-circular front head inserted through the guide hole of said locating plate and stopped against the push rod of said main lever.

4. The airbrush of claim 1 wherein said barrel comprises two transverse mounting holes aligned at two opposite sides, a fluid tube selectively fastened to one of said transverse mounting holes and adapted to receive said fluid cup, and a plug adapted to close one of said transverse mounting holes.

5. The airbrush of claim 1 further comprising a nozzle element installed in the front end of said nozzle head and adapted to receive said needle for enabling said needle to close said paint passage, said nozzle element comprising a narrow axial center through hole disposed in communication between said nozzle tip and the longitudinal center through hole and adapted to receive said needle.

6. The airbrush of claim 1 wherein the push rod of said main lever is formed integral with the periphery of said main lever.

* * * * *